US006766625B2

(12) United States Patent
Cinotti

(10) Patent No.: US 6,766,625 B2
(45) Date of Patent: Jul. 27, 2004

(54) APPARATUS AND RELATIVE METHOD FOR WRAPPING REAMS OF PAPER

(75) Inventor: Andrea Cinotti, Bologna (IT)

(73) Assignee: Innopack S.r.l., Calderara Di Reno (IT)

( * ) Notice: Subject to any disclaimer, the term of this patent is extended or adjusted under 35 U.S.C. 154(b) by 0 days.

(21) Appl. No.: 10/306,519

(22) Filed: Nov. 27, 2002

(65) Prior Publication Data

US 2003/0167736 A1 Sep. 11, 2003

(51) Int. Cl.[7] ..... B65B 11/12
(52) U.S. Cl. ..... 53/230; 53/231; 53/376.5
(58) Field of Search ..... 53/466, 230, 231, 53/228, 376.5, 377.4

(56) References Cited

U.S. PATENT DOCUMENTS 1,466,814 A * 9/1923 De Escobales ..... 53/230
1,646,497 A * 10/1927 Sandberg ..... 53/230
2,609,646 A * 9/1952 Total ..... 53/230
2,739,431 A * 3/1956 Griswold et al. ..... 53/231
3,110,143 A * 11/1963 Schooler ..... 53/230
3,507,091 A * 4/1970 Mizelle et al. ..... 53/230
3,996,728 A 12/1976 Gentili
4,653,248 A * 3/1987 Bergner et al. ..... 53/231
4,738,078 A 4/1988 Benz et al.
5,072,572 A 12/1991 Meives et al.
5,133,173 A * 7/1992 Draghetti et al. ..... 53/466

FOREIGN PATENT DOCUMENTS

DE 42 06 968 A1 9/1992
EP 0 515 320 A1 11/1992

* cited by examiner

*Primary Examiner*—John Sipos
(74) *Attorney, Agent, or Firm*—Michael Best & Friedrich LLP

(57) ABSTRACT

An apparatus for wrapping reams of paper in which the units for forming the first tube are adjacent to the devices for lateral folding of the first tube in order simultaneously to form lateral flaps.

11 Claims, 11 Drawing Sheets

31

APPARATUS AND RELATIVE METHOD FOR WRAPPING REAMS OF PAPER

The present invention relates to an apparatus and a method for wrapping reams of paper.

BACKGROUND OF THE INVENTION

As is known, an apparatus for wrapping reams of paper generally comprises:

(a) a unit for forming and feeding the reams along a path;

(b) units for forming the first tube for wrapping of the ream of paper with a wrapping sheet;

(c) devices for the lateral folding of the first tube in order to form lateral flaps so as to obtain two lower tongues and two upper tongues;

(d) folding devices for the upper tongues;

(e) spray devices adapted to spray an adhesive substance on the inner surfaces of the lower tongues;

(f) devices for folding the lower tongues over the respective upper tongues, already folded, in order to obtain a pack containing the ream.

Apparatus of this type have the drawback, however, that they are not very compact and are not adapted to process reams of small format.

SUMMARY OF THE INVENTION

The object of the present invention is therefore to provide an apparatus and a relative method for wrapping a ream of paper which is free from the drawbacks described above.

The apparatus of the present invention is therefore characterised in that the units for forming the first tube are adjacent to the devices for the lateral folding of this first tube in order simultaneously to form the lateral flaps.

The present invention therefore relates principally to an apparatus for wrapping reams of paper in accordance with the characteristic features claimed in claim 1.

A further object of the present invention is a novel method for wrapping reams of paper in accordance with the characteristic features claimed in claim 10.

BRIEF DESCRIPTION OF THE DRAWINGS

The present invention will be described below with reference to the accompanying drawings which show a non-limiting embodiment thereof and in which.

DETAILED DESCRIPTION OF THE INVENTION

Figure 1:
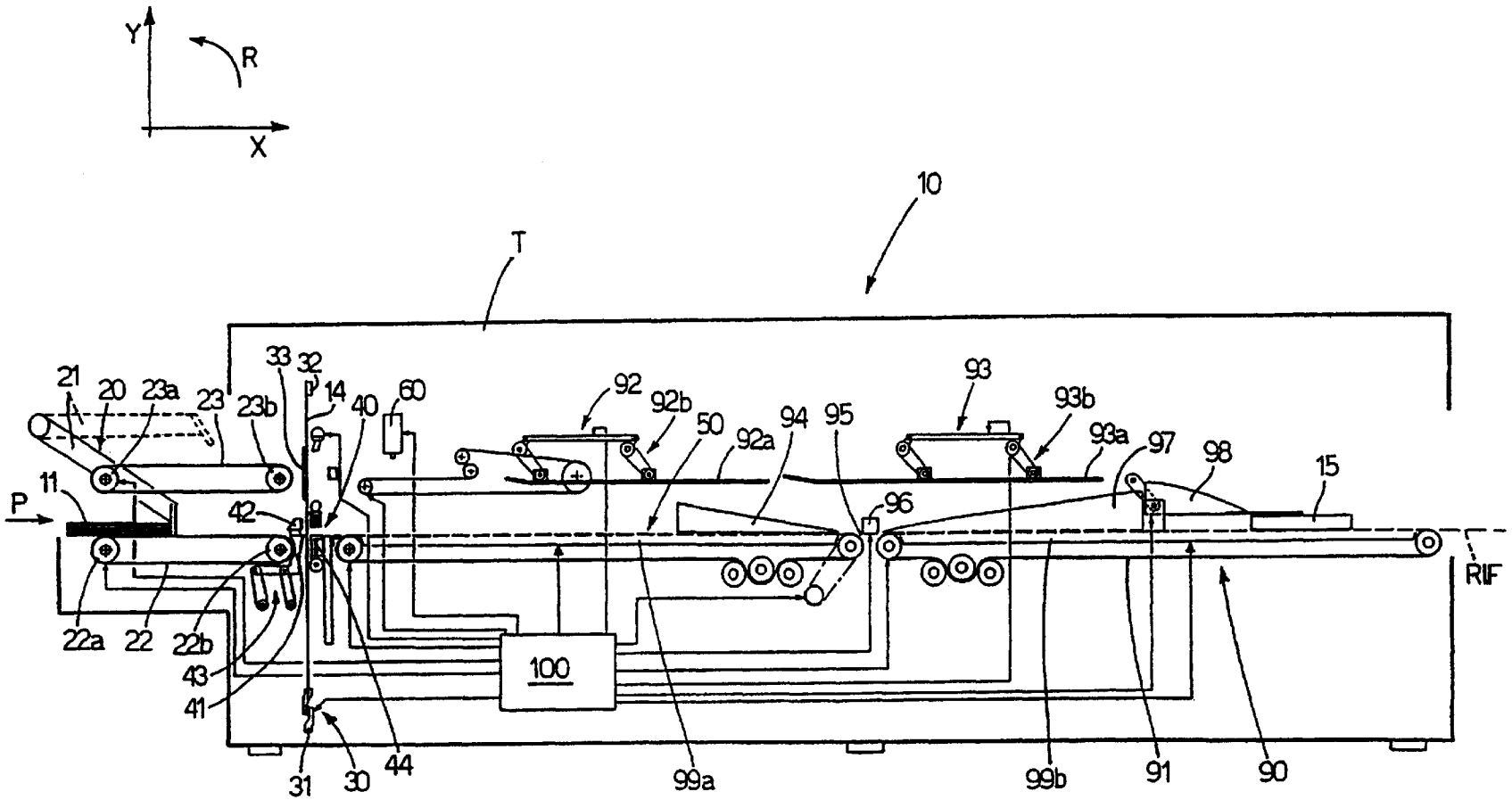
FIG. 1 is a side view of an overall unit of the apparatus of the present invention in a first phase of operations for wrapping a ream of paper.
Figure 15:
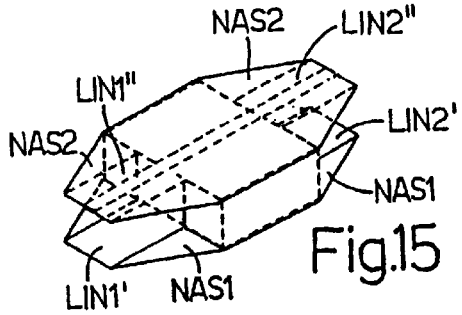

In FIG. 1, an apparatus for wrapping reams 11 of sheets of paper 12 in relative wrapping sheets 14 to form packs 15, one of which is shown in FIG. 15, is shown overall by 10.

Figure 11:
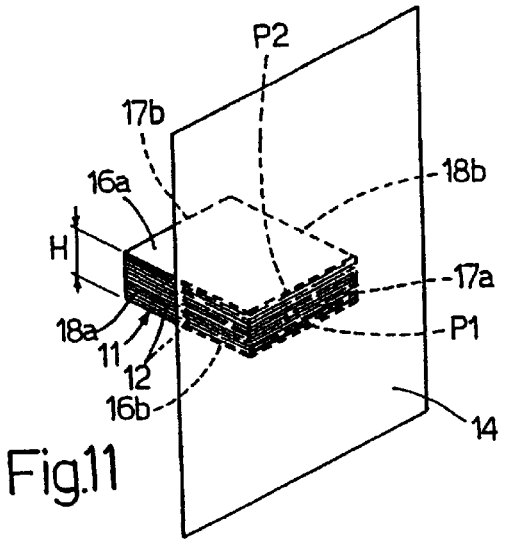
FIGS. 11 to 18 are perspective views of a ream of sheets and a relative wrapping sheet in different phases of the method of the present invention.

In further detail, and with reference to FIG. 11 as well, each ream 11 comprises a certain number of sheets 12 which are stacked and aligned on top of one another in order to provide the ream 11 with the shape of a prism with a rectangular base and a height H.

The ream 11 has two parallel and opposing faces 16*a*, 16*b*, each of which is defined by an end sheet 12 of the ream 11. The ream 11 is further defined by two front faces 17*a*, 17*b* which are parallel with one another and perpendicular to the base face 16*b* and two lateral faces 18*a*, 18*b* which are also parallel to one another and perpendicular to the base face 16*b*.

The rectangular prism shape of the ream 11 depends on the superimposition of the sheets 12, which are in contact with one another as a result of the friction between the adjacent sheets 12 of the ream 11, when the forces acting on the ream 11 are contained within certain predetermined values.

In FIG. 1, the apparatus 10 firstly comprises a frame T adapted to support the various units making up this apparatus 10 (see below).

Looking in more detail at the apparatus 10 of FIG. 1, and moving from the left to the right of the drawing, there is a unit 20 for forming and feeding the reams 11 along X and along a path P. The unit 20 firstly comprises a device 21 for locking and forming the reams 11 so as fully to align the sheets 12 on one another.

Using known means, the device 21 is raised until it reaches the position shown in dashed lines in FIG. 1 in order to enable the successive feeding of the ream 11 along the path P.

The unit 20 further comprises a lower belt conveyor 22 wound about a pair of pulleys 22*a*, 22*b*, and an upper belt conveyor 23 also wound, in turn, about a pair of pulleys 23*a*, 23*b*. While the conveyor 22 is fixed with respect to a reference plane RIF, the upper conveyor 23 may be moved by a device (not shown) in a direction shown by Y and perpendicular to this reference plane RIF.

After the ream 11 has been formed by the action of the device 21, the upper conveyor 23 is lowered so that the ream 11 is tight between the lower conveyor 22 and the upper conveyor 23.

The reams 11, as they are formed, are fed from the unit 20 to a unit 30 for supplying wrapping sheets 14 (see FIG. 11 as well) and to a folding unit 40.

The components of the units 30 and 40 will be described in further detail below.

It will be appreciated that, although the present description of the particular embodiment shown in the accompanying drawings makes explicit reference to sheets of wrapping paper 14 taken individually, i.e. cut from a spool (not shown), there is nothing to prevent the present invention from being applied to a spool of paper which, by means of an adapted supply unit (not shown), is fed directly to the folding unit 40.

As shown in FIG. 1, the motorisation of the pulleys 22*a* and 23*a* relating respectively to the lower conveyor 22 and the upper conveyor 23 is controlled by an electronic control unit 100. This regulation irrespective of the speed of rotation of the electric motors (not shown) of the pulleys 22*a* and 23*a* is necessary to provide identical drive speeds along the rectilinear sections of the conveyors 22 and 23.

This is also necessary to prevent, when the type of belt used in the conveyors 22, 23 is changed or as a result of the wear of the belts (which causes their thickness to vary), different peripheral speeds in respect of the two conveyors 22, 23. Were this to happen, there would be relative displacements of the upper face 16*a* with respect to the lower face 16*b*, causing the relative ream 11 to come out of alignment.

Looking now at the unit 30 for supplying wrapping sheets 14 (FIG. 1), it will be appreciated that this unit 30 comprises a lower gripper unit 31 and an upper gripper unit 32 which hold the wrapping sheet 14 taut in a position substantially parallel to Y and therefore perpendicular to the path P and the plane RIF. The lower gripper unit 31 and the upper gripper unit 32 are on opposite sides with respect to the plane RIF. The unit 30 further comprises a vertical wall 33 on which a portion of the wrapping sheet 14 bears.

As will be described below in detail, the wall 33 and the devices making up the folding unit 40 form a mandrel for wrapping the ream 11.

Figure 9:
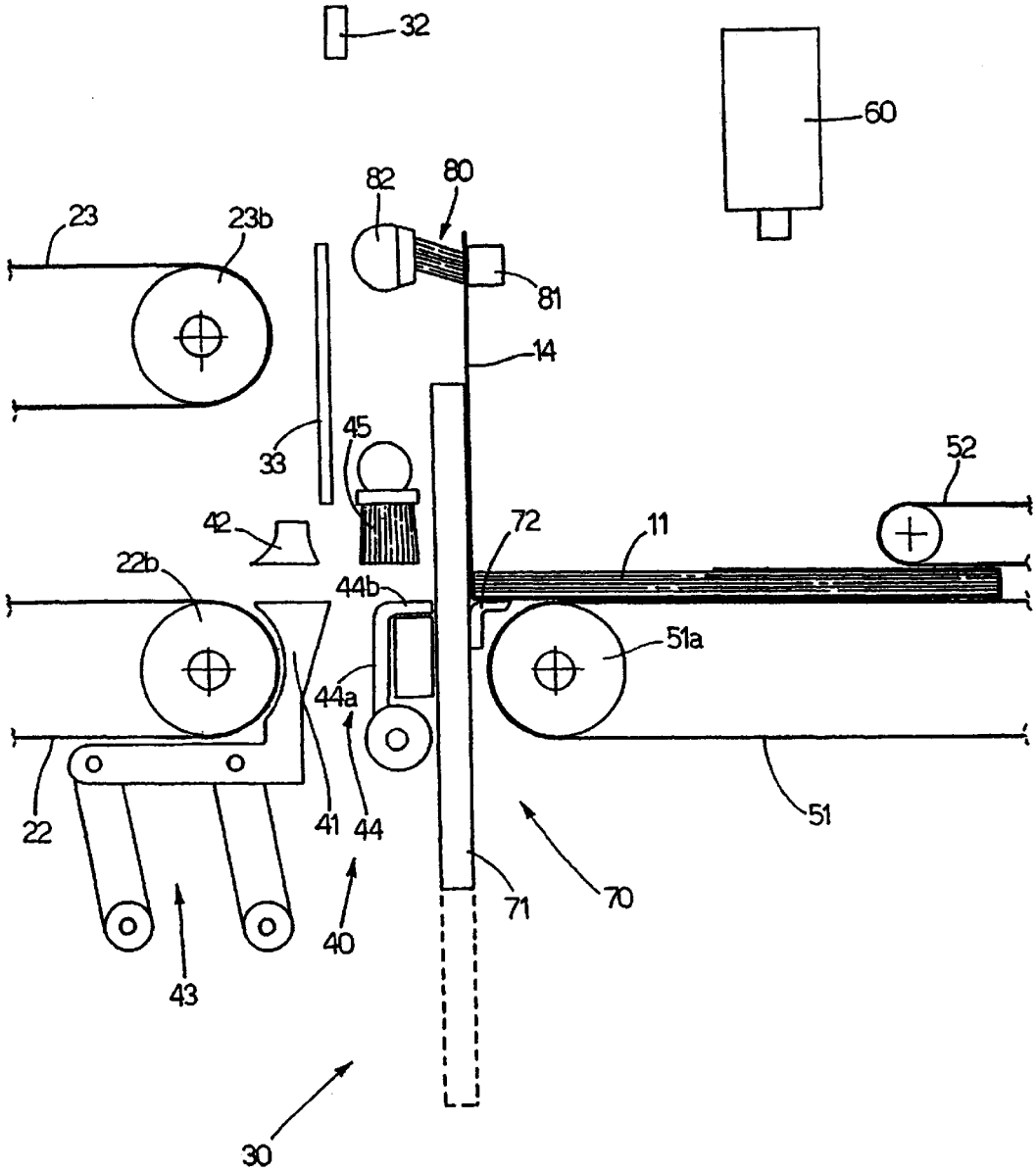
FIG. 9 shows some details of the apparatus shown in FIG. 7 on an enlarged scale.

The folding unit 40 comprises (see FIG. 9 as well) a lower folding member 41 and an upper folding member 42 also disposed on opposite sides with respect to the plane RIF.

Figure 2:
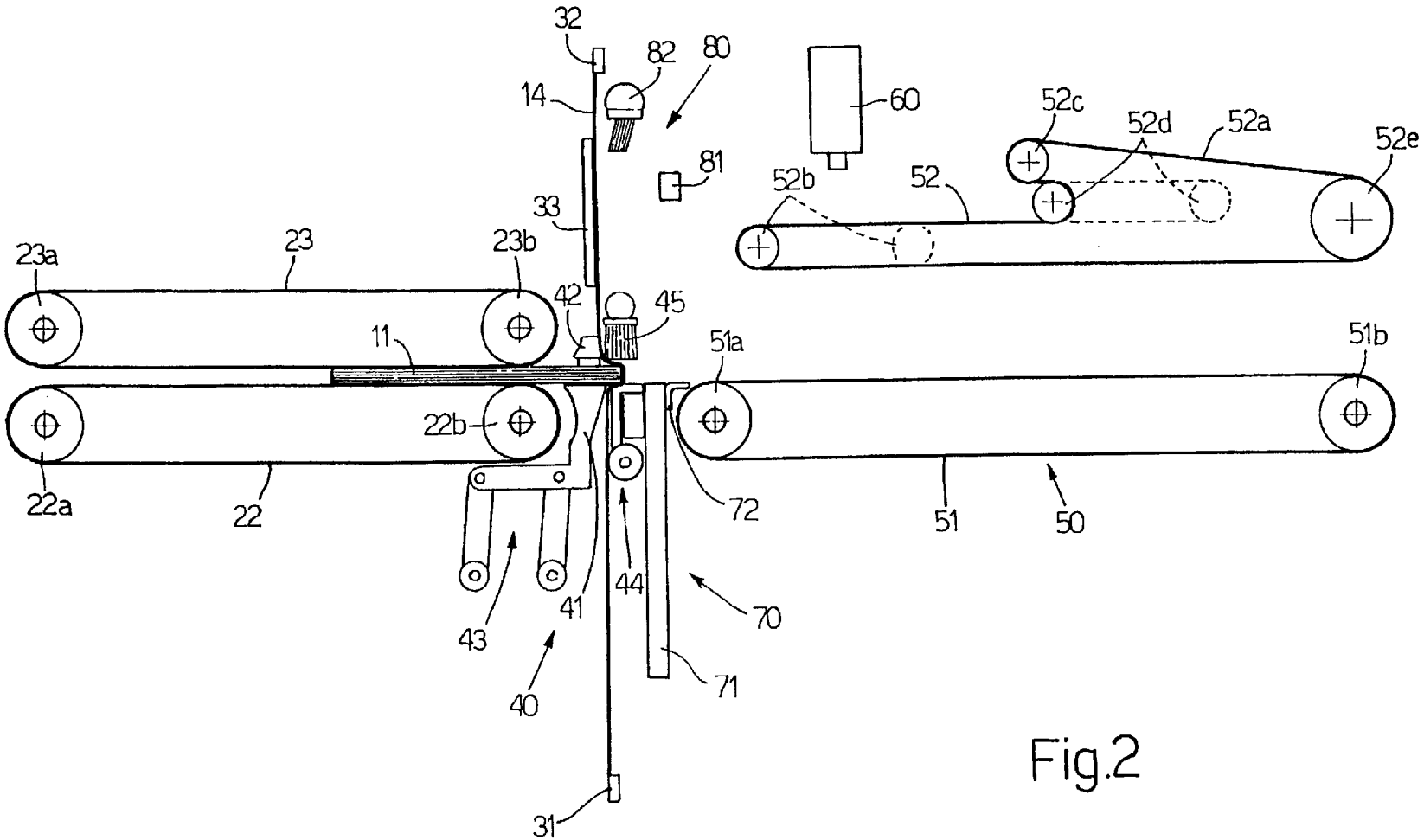
FIG. 2 is a side view of the overall unit of the apparatus of FIG. 1 in a second phase of operations for wrapping a ream of paper (some parts being omitted to make the drawing easier to read)

The two folding members 41, 42 are moved synchronously by an articulated quadrilateral mechanism 43 from a first retracted position (with respect to the path P) shown, for instance, in FIG. 1, to a second forward position (again with respect to the path P) shown, for instance, in FIG. 2.

In the forward position (FIG. 2), the folding member 41 is in abutment on a block 44, while the folding member 42 enters into contract with a brush member 45 whose bristles are disposed perpendicular to the plane RIF. The block 44 is, moreover, substantially L-shaped, with a vertical portion 44*a* perpendicular to the plane RIF and a shorter horizontal portion 44*b* lying in this plane RIF.

As shown in FIG. 2, moreover, when the ream 11, under the action of the conveyors 22, 23, comes into contact with the wrapping sheet 14, the lower gripper unit 31 is raised in the direction of the plane RIF, while the upper gripper unit 32 is lowered, again in the direction of the plane RIF. The wrapping sheet 14 is caused to adhere to the face 17*a* (see FIG. 11 as well), however, by the pull of the gripper units 31, 32 on this wrapping sheet 14.

As shown in FIG. 2, during this phase, the wrapping sheet 14, as well as adhering to the face 17*a*, bears partially on the faces 16*a*, 16*b*, assisted by the fact that the simultaneous feed (along the path P) of the mechanism 43 has made it possible to form a lower fold P1 (see FIG. 11 as well) as a result of the fact that the member 41 has borne on the vertical portion 44*a* of the block 44, and to form an upper fold P2 as a result of the contact of the member 42 with the brush member 45.

Obviously, as shown in FIG. 11 as well, the fold Pi is formed at the location of the edge of intersection between the lower face 16*b* of the ream 11 and the front face 17*a* of this ream, while the fold P2 is formed at the location of the edge of intersection between the upper face 16*a* of the ream 11 and the front face 17*a*.

Figure 3:
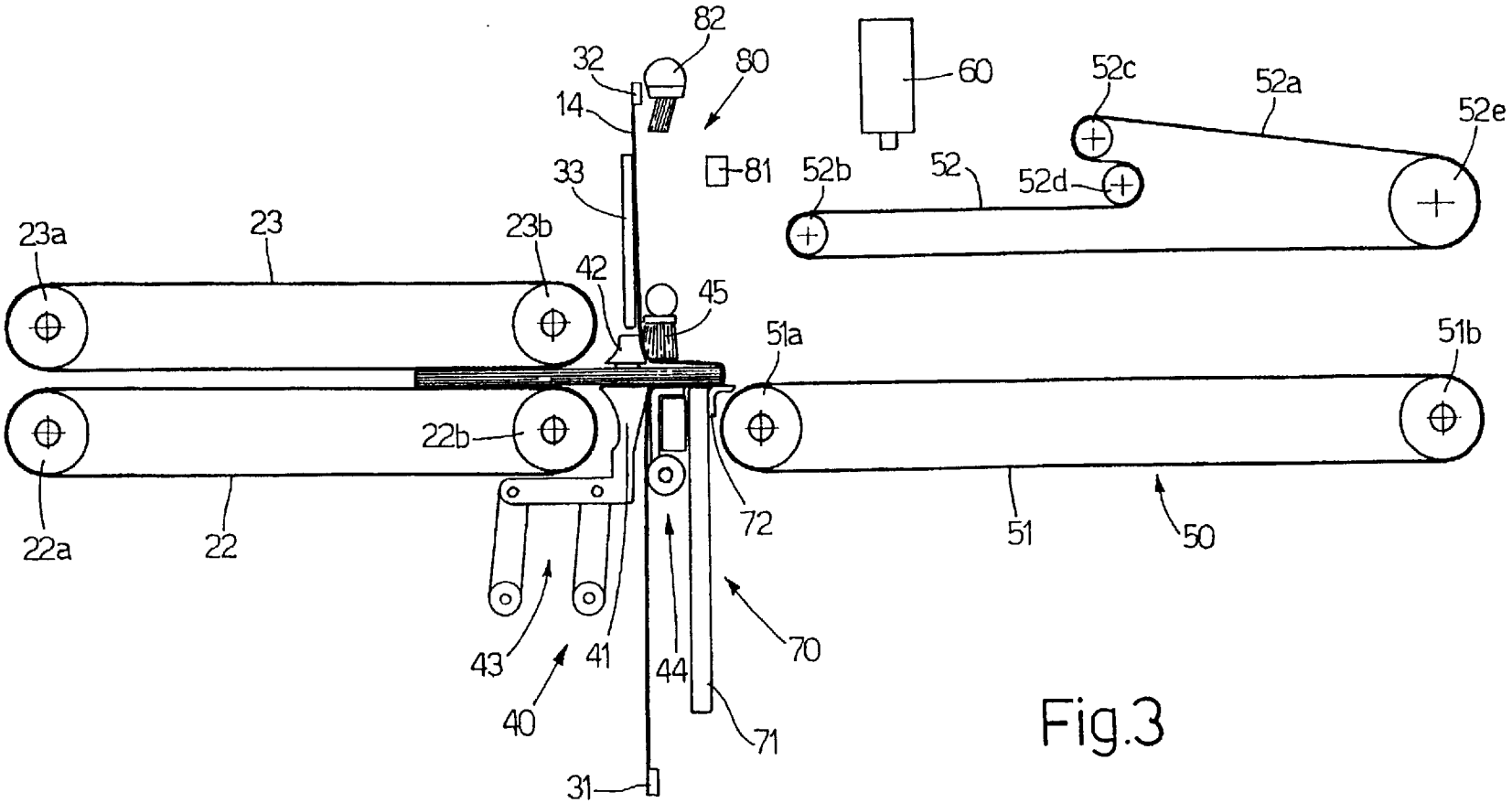
FIG. 3 is a side view of an overall unit of the apparatus of FIG. 2 in a third phase of operations for wrapping a ream of paper.

As shown in FIG. 3, the ream 11 is conveyed further by the conveyors 22, 23 such that portions of growing amplitude of the wrapping sheet 14 bear on the faces 16*a*, 16*b* of the ream 11. The operation to "smooth" the wrapping sheet 14 is assisted by the action of the horizontal portion 44*b* of the block 44 on the lower face 16*b* of the ream 11 lying in the plane RIF, while the brush device 45 carries out the above-mentioned smoothing operation on the upper surface 16*a* of this ream 11.

Figure 4:
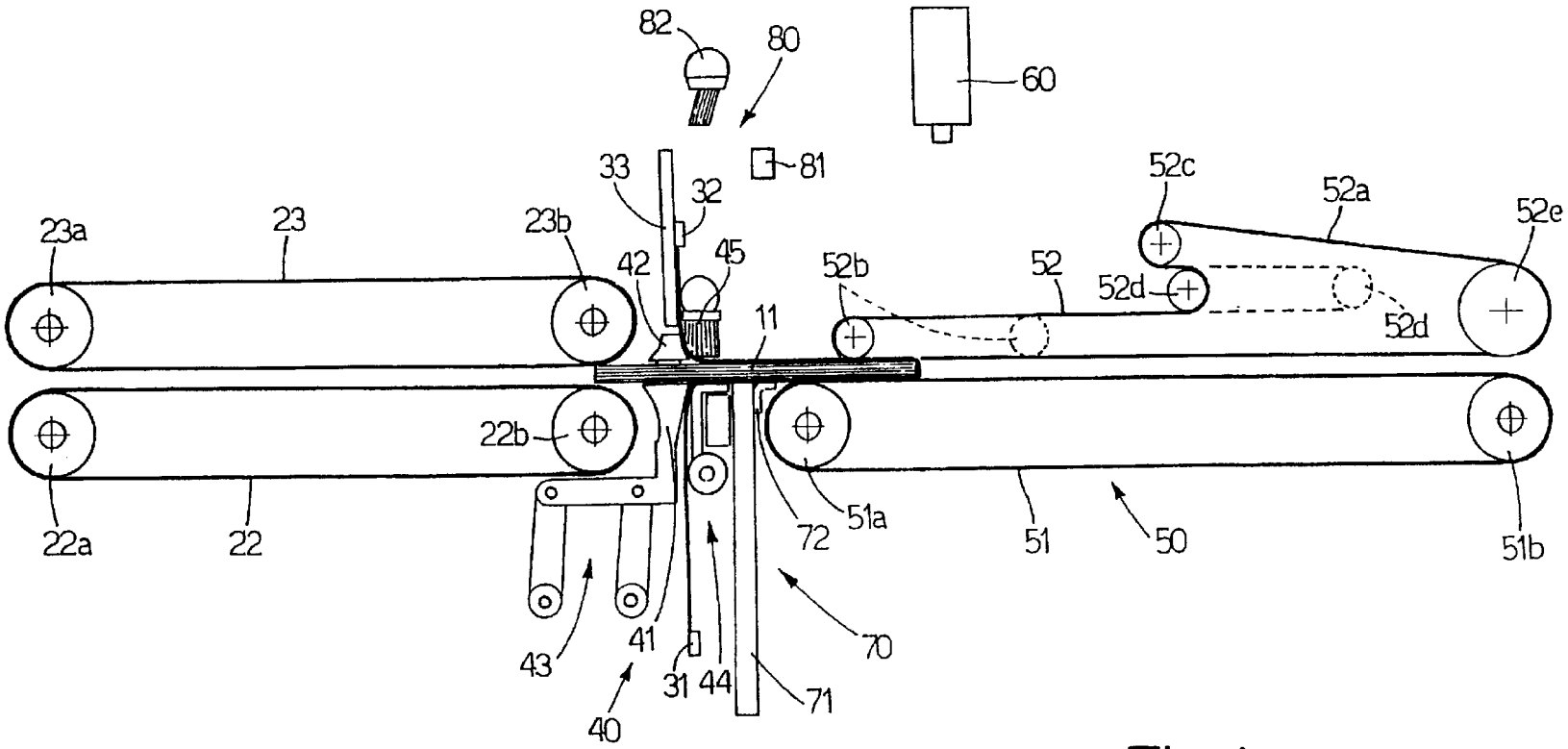
FIG. 4 is a side view of an overall unit of the apparatus of FIG. 2 in a fourth phase of operations for wrapping a ream of paper.

FIG. 4 shows the situation in which the ream 11 continues to be fed under the action of the conveyors 22, 23, with the wrapping sheet 14 which winds ever further about this ream 11.

FIG. 4 also shows a configuration of the apparatus 10 in which the ream 11, partially covered by the wrapping sheet 14, is taken up by a distancing unit 50.

This unit 50 comprises, in turn, a lower belt conveyor 51, which is fixed and lies in the plane RIF, and an upper belt conveyor 52 of retractile type. The lower conveyor 51 comprises a belt and a pair of pulleys 51*a*, 51*b*. The upper conveyor, however, comprises a belt 52*a* wound about a series of four pulleys 52*b*–52*e*. In FIG. 4, the upper conveyor 52 is fully deployed, i.e. the pulleys 52*b* and 52*d* are displaced, by means which are not shown, towards the folding unit 40 so as to locate the ream 11, which is then taken up by the conveyors 51, 52.

Figure 5:
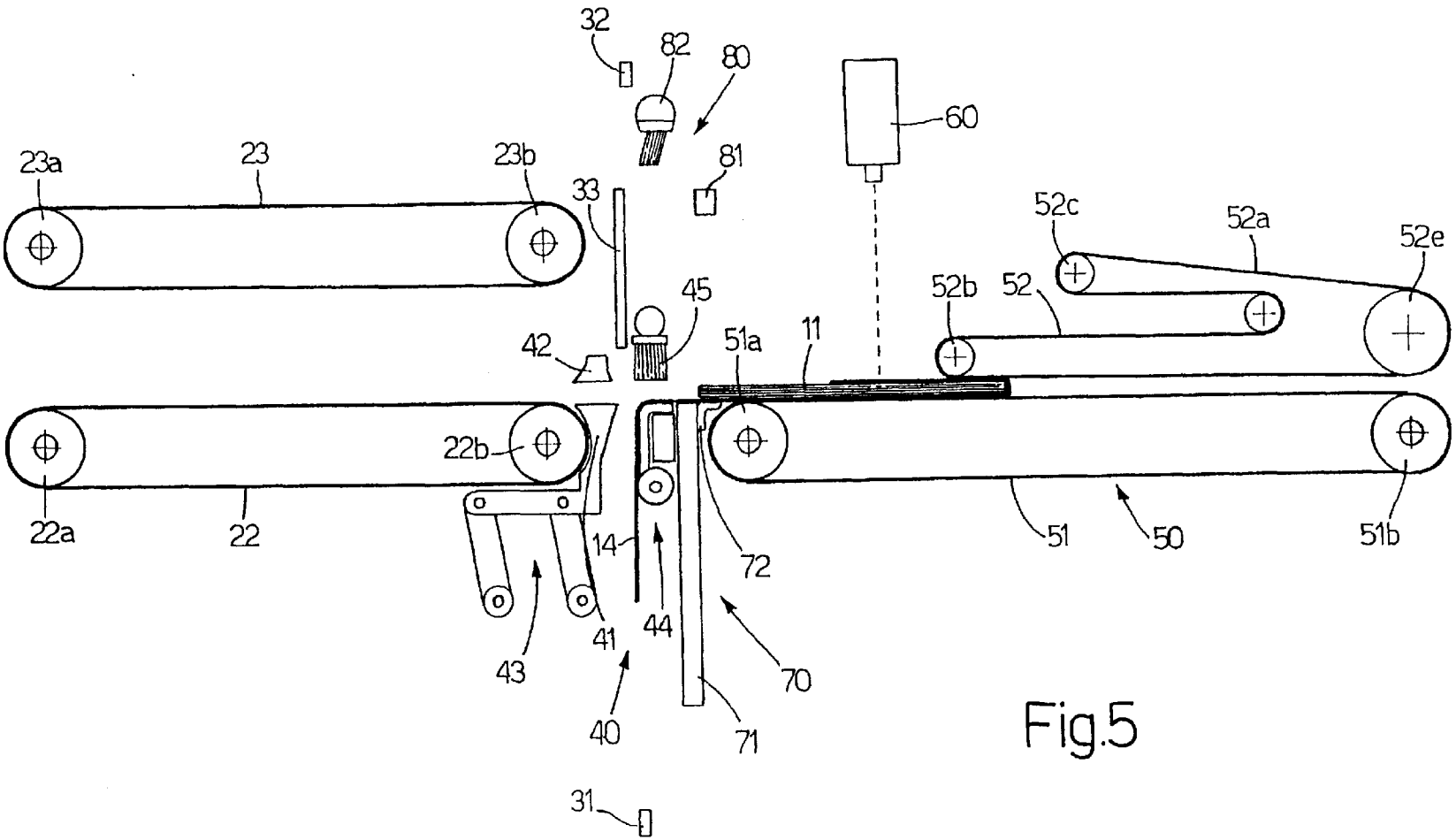
FIG. 5 is a side view of an overall unit of the apparatus of FIG. 2 in a fifth phase of operations for wrapping a ream of paper.
Figure 12:
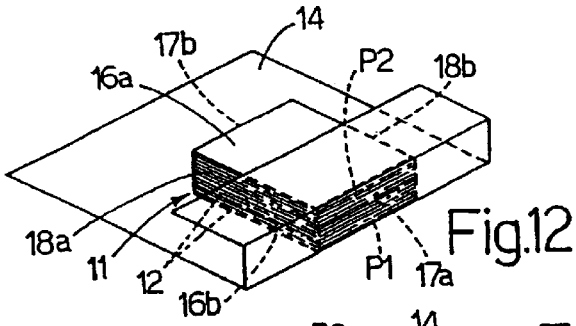

In FIG. 5 (see FIG. 12 as well), the ream 11 is fed only by the unit 50, while the feed unit 20, which is no longer in contact with the ream 11, is again opened by distancing the conveyor 23 from the conveyor 22, and is ready for the transport of a new ream 11 (not shown). At the same time, as shown in FIG. 5, the pulleys 52*b* and 52*d* (position shown in dashed lines) are displaced along X reducing the longitudinal bulk of the conveyor 52 for a purpose that will be explained below.

The upper portion of the wrapping sheet 14 has been released by the upper gripper unit 32 (which, in the meantime, takes up another subsequent sheet 14 in order to wrap the subsequent ream 11) and bears completely on the face 16*a* of the ream 11 as a result also of the action of the brush device 45. The lower portion of the wrapping sheet 14 is also no longer retained by the lower gripper unit 31 (which, in the meantime, takes up another successive wrapping sheet 14 in order to wrap the successive ream 11). The lower portion of the wrapping sheet 14 then completely covers the lower face of the ream 11 and lies on the horizontal portion 44*a* of the block 44.

In the phase shown in FIG. 5, profiting from the fact that the conveyor 52 is in the retracted position, the outer surface of the upper limb of the wrapping sheet 14 which, as mentioned above, is wound on the upper face 16*a* of the ream 11, is sprayed with an adhesive substance. The adhesive substance is sprayed by a spray device 60 whose longitudinal axis is perpendicular to the plane RIF.

Moreover, a folding unit 70 is disposed between the block 44 and the conveyor 51 and comprises a wall 71 adapted to slide, moved by devices which are not shown, into an interstice 72 provided on the surface RIF.

The interstice 72 is immediately downstream of the block 44 in the direction of the path P.

The movement of the wall 71 is a conventional guillotine movement within the interstice 72 and is adapted to urge the end portion of the lower limb of the wrapping sheet 14 upwards. The wall 71 moves along Y (FIG. 6).

Figure 7:
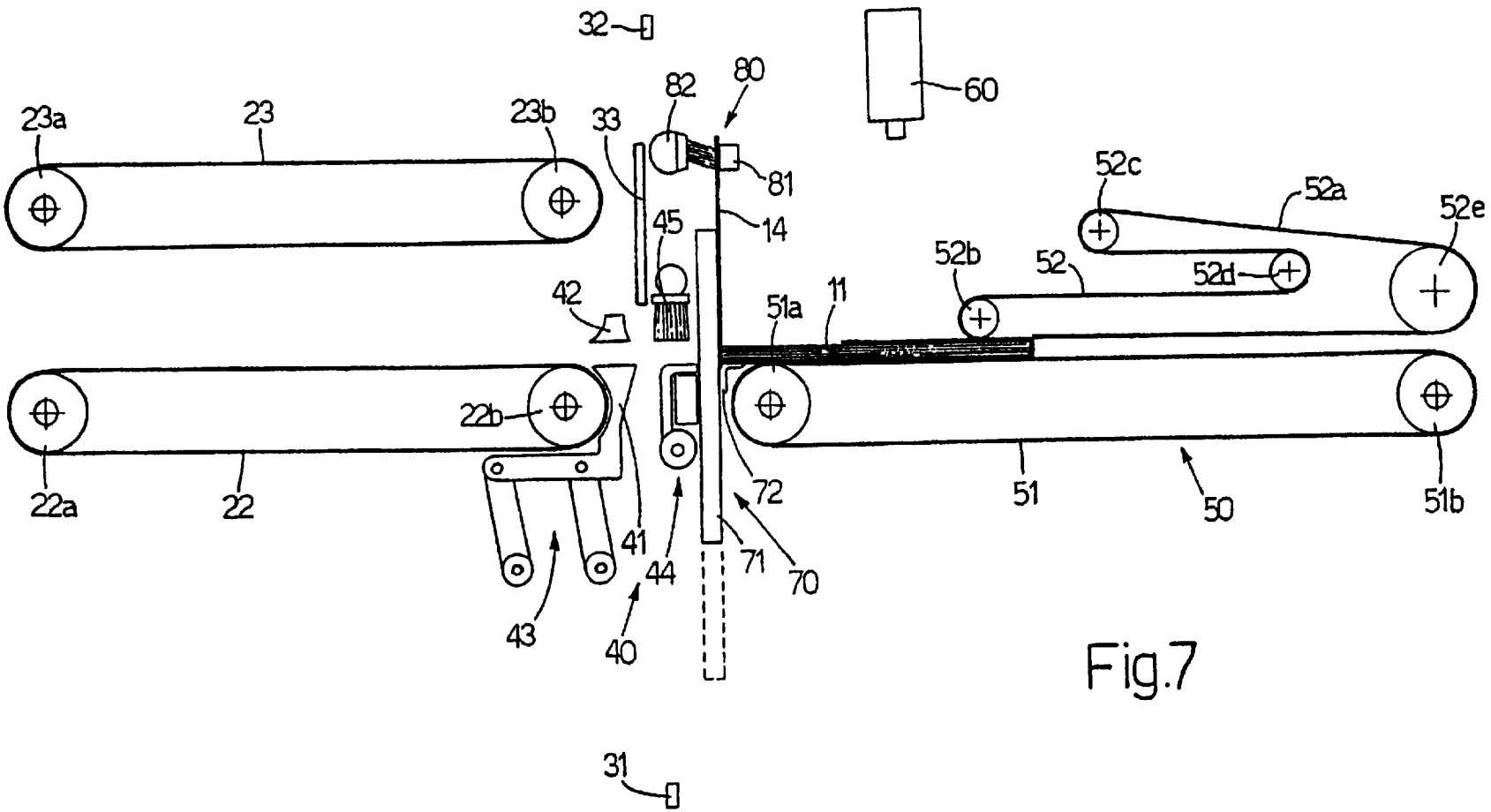
FIG. 7 is a side view of an overall unit of the apparatus of FIG. 2 in a seventh phase of operations for wrapping a ream of paper.

As shown in FIG. 7, this end portion of the limb is retained for an instant in a vertical position by a retaining unit 80.

Figure 6:
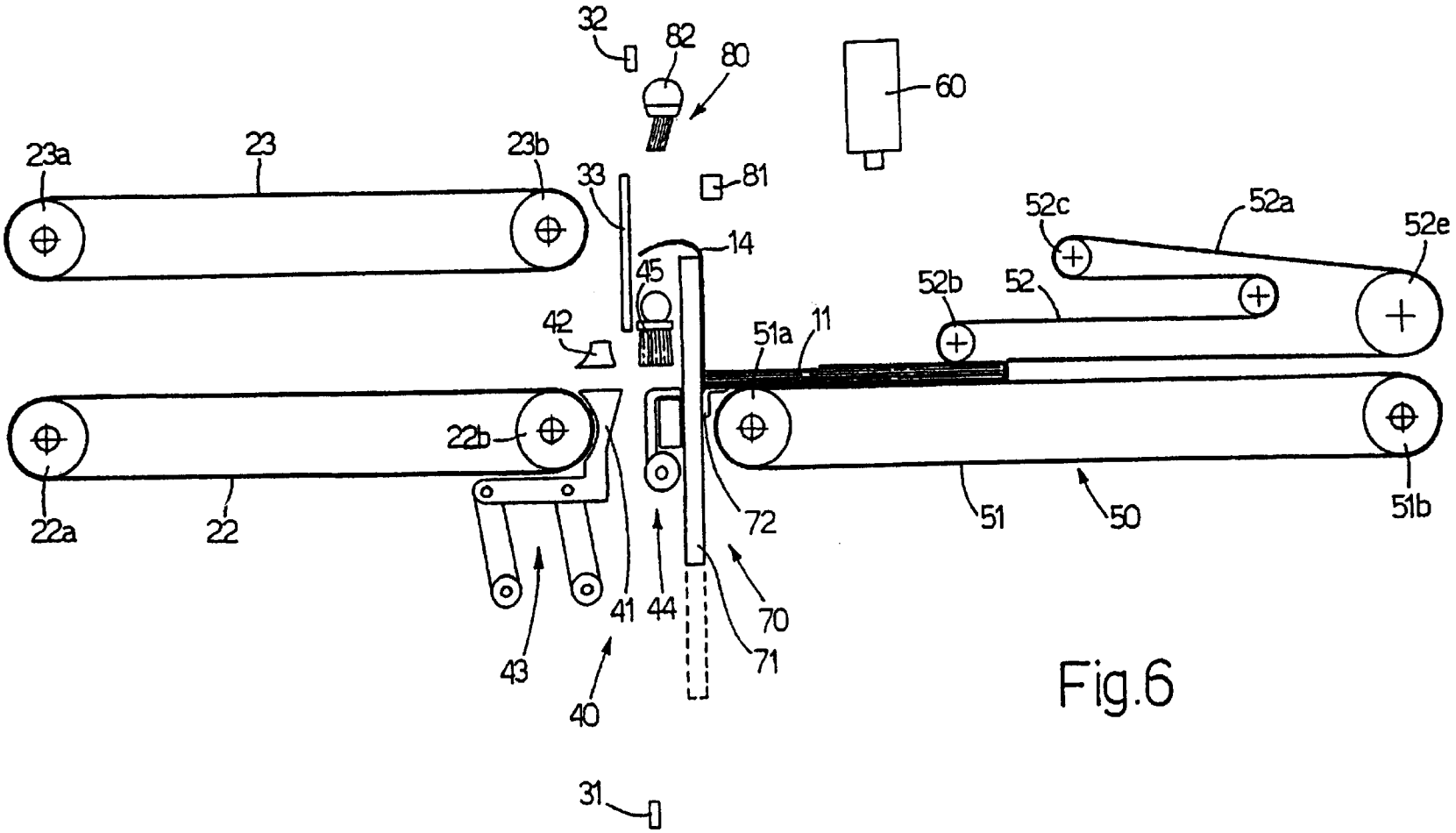
FIG. 6 is a side view of an overall unit of the apparatus of FIG. 2 in a sixth phase of operations for wrapping a ream of paper.

The retaining unit 80 in turn comprises a stop 81 and a brush device 82 which, as can be seen from a comparison of FIG. 6 with FIG. 7, is adapted to move along Y and to rotate about R.

In the take-up position of the lower limb of the wrapping sheet 14, the brush device 82, moved by adapted mechanisms (not shown), has been vertically displaced and has rotated such that this lower limb is retained between the stop member 81 and the bristles of the brush device 82.

In an embodiment which is not shown, the function of retaining the lower limb of the wrapping sheet 14 is performed by a vacuum retaining device (not shown).

Figure 8:
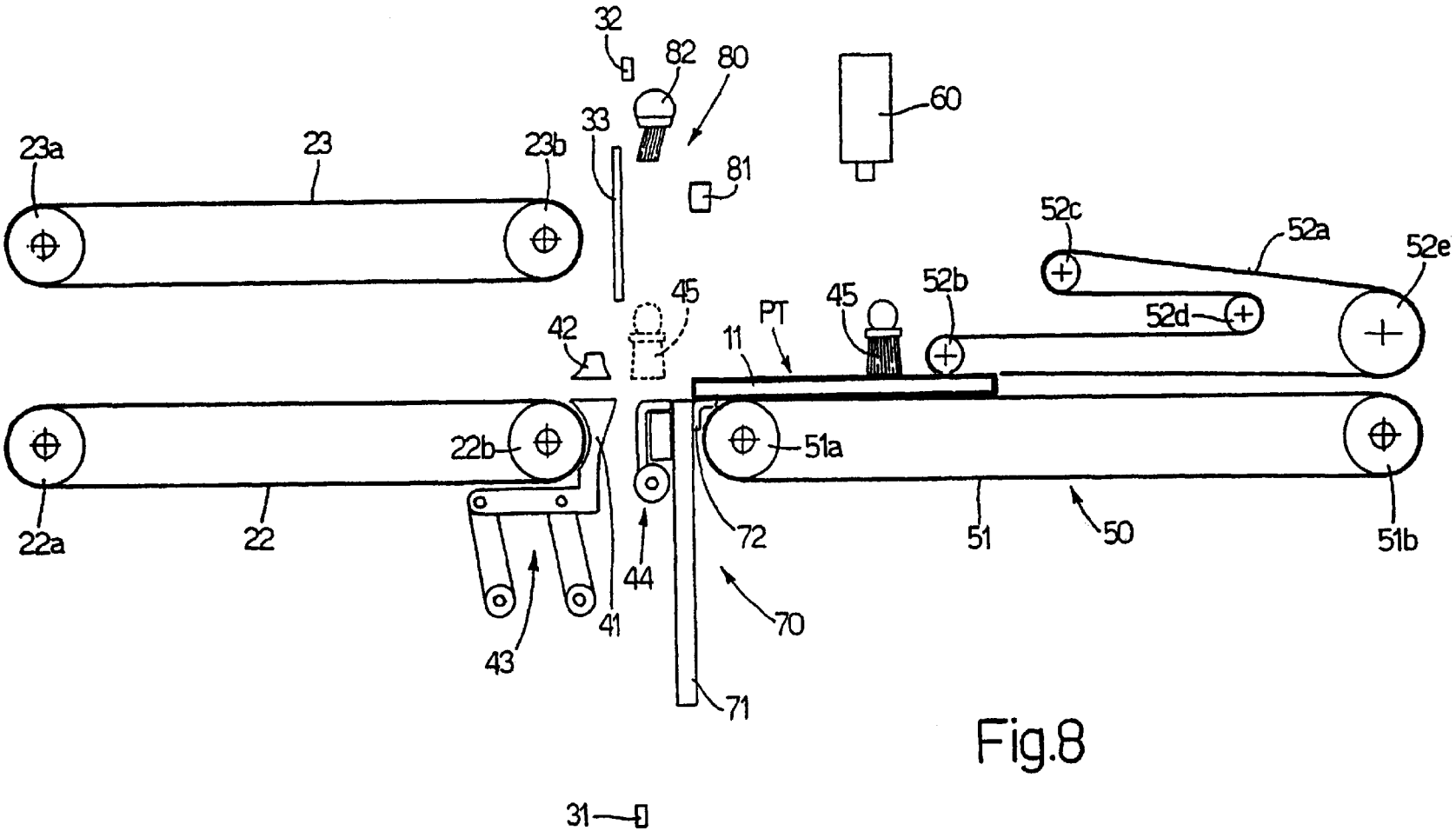
FIG. 8 is a side view of an overall unit of the apparatus of FIG. 2 in an eighth phase of operations for wrapping a ream of paper.

FIG. 8 shows the phase in which the lower limb has been released by the retaining unit 80, while the brush device 45 is displaced along X in order to "smooth" the lower limb on the outer surface of the upper limb of the wrapping sheet 14 which, as mentioned above, has already received the adhesive substance from the spray device 60 (FIG. 5).

Figure 13:
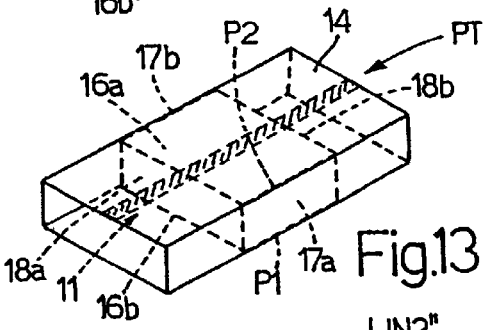

The "first wrapping tube" PT has been formed in this way (see FIG. 13 as well) and is then subject to the successive folding and adhesive operations which will be explained below in further detail.

Figure 10:
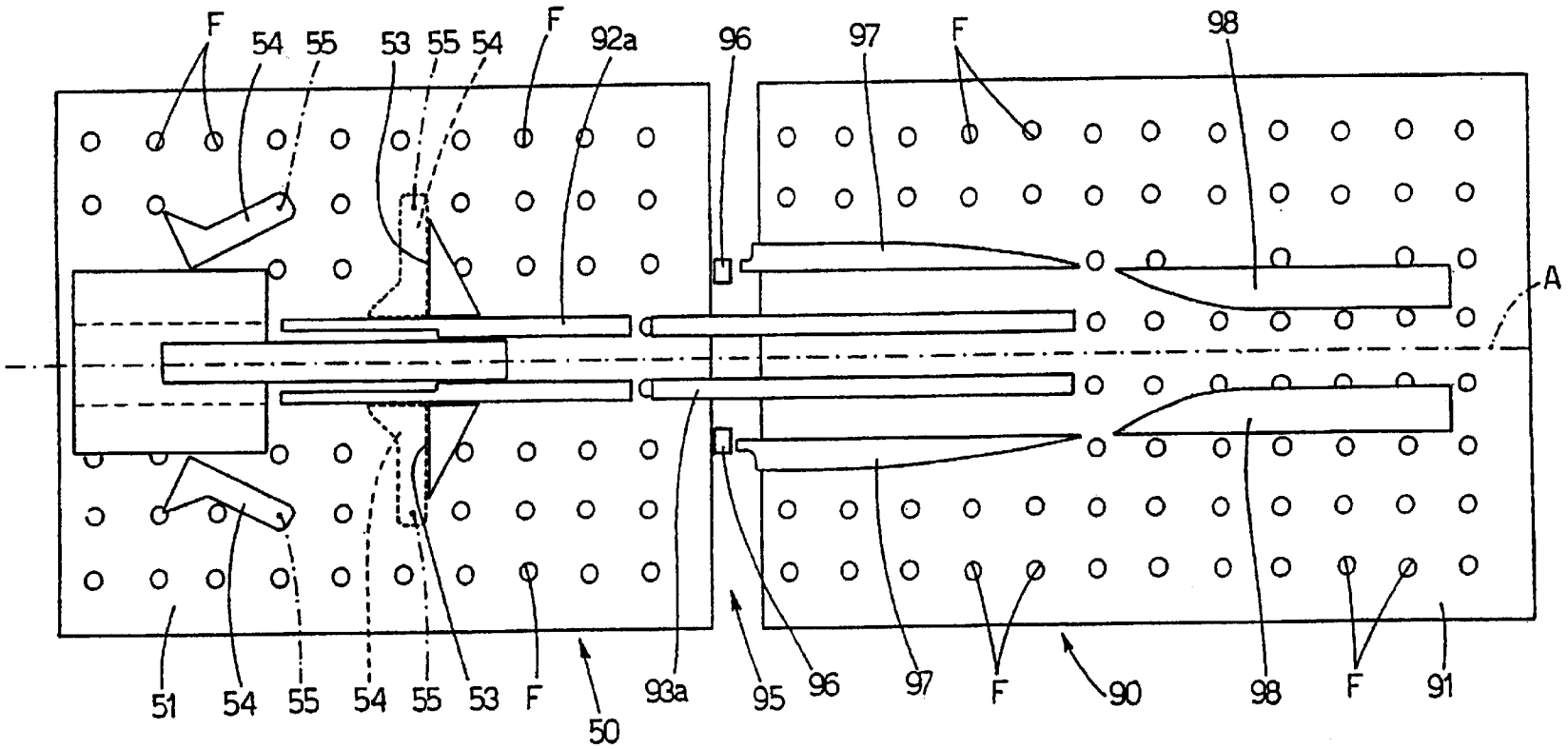
FIG. 10 is a plan view of the overall unit of the apparatus of FIG. 2.

In order to simplify the description, it will now be better to turn to the plan view of FIG. 10 in which the same reference numerals have been used for members that can be readily recognised and are also shown in the other Figures.

By displacing some devices, it is possible to adapt the apparatus 10 to different formats of reams 11.

FIG. 10 in particular shows the configuration of the apparatus 10 used to process small-format reams 11.

Figure 14:
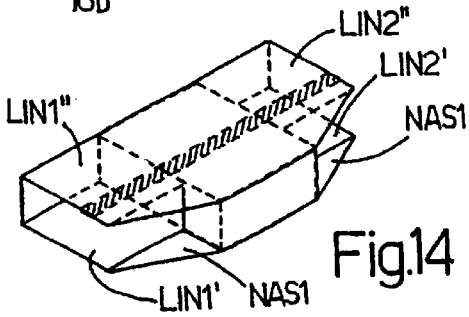

Along the path P, the first tube PT (see FIG. 14 as well) encounters two abutments 53 disposed symmetrically on opposite sides of an axis of longitudinal symmetry A (FIG. 10).

The portions of the first tube PT projecting with respect to the bulk of the ream 11 encounter the abutments 53 and are folded to form two front flaps NAS1 (FIG. 14) and four relative tongues LIN1', LIN1", LIN2' and LIN 2".

In order, however, to form two rear flaps NAS2 (FIG. 15), two arms 54 (FIG. 10) are used, which, by rotating about an axis 55 (perpendicular to the plane of the sheet as shown in FIG. 10) and moving along X, fold the wrapping sheet 14 in the desired manner. At the end of the movement to form the rear flaps NAS2, each of the two arms 54 bears on the respective abutment 53.

In other words, the arms 54 are arms that "follow" the ream 11, partially wound about by the wrapping sheet 14, along the path P.

As shown in FIG. 10, the distancing unit 50 is followed along the path P by a removal unit 90 (see FIG. 1 as well) in turn comprising a lower belt conveyor 91 of known type.

FIGS. 1 and 10 also show two pressure devices 92 and 93 disposed in series with one another.

The pressure device 92 (FIG. 1) in turn comprises a pressure member 92*a* moved by an articulated parallelogram mechanism 92*b*. Similarly, the pressure device 93 comprises a pressure member 93*a* moved by an articulated parallelogram mechanism 93*b*.

The pressure devices 92, 93 are adapted to keep the ream 11, already partly wrapped, under pressure on exit from the distancing unit 50. The pressure exerted by the pressure members 92*a* and 93*a* on the upper face of the partial wrapping facilitates the mutual adhesion of the limbs of wrapping paper 14 superimposed on the upper face 16*a* of the ream 11.

Figure 16:
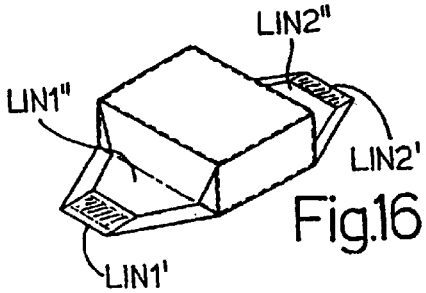

Prior, however, to leaving the distancing unit 50, the tongues LIN1" and LIN2" are folded downwards by means of a helical folding device 94 in order to form the partial wrapping shown in FIG. 16.

Moreover, as can be readily seen from FIGS. 1 and 10, a free space 95 is provided between the conveyor 51 and the conveyor 91, whose upper faces both lie in the plane RIF, at the location of which space two spray devices 96, adapted to spray adhesive substance on the inner surfaces of the tongues LIN1' and LIN2', as shown in FIG. 16, are positioned on opposite sides with respect to the axis A. The longitudinal axes of the two spray devices 96 are perpendicular to the plane RIF.

The positioning of the spray devices 96 at the location of the free space 95 is important, as this prevents glue from being sprayed and being deposited in an undesired manner on the conveyors 51 and 91 as well, with the adverse effects that this would entail.

At the start of the removal unit 90 there are two helical folding devices 97 of known type, disposed on opposite sides with respect to the axis A and at an equal distance from this axis A.

Figure 17:
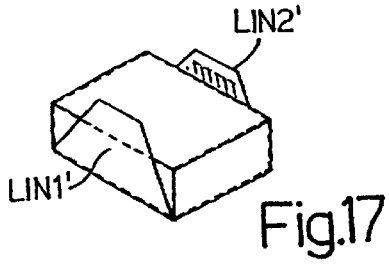

With reference to FIG. 17 as well, the folding devices 97 are adapted upwardly to fold the tongues LIN1' and LIN2', which are then glued on the tongues LIN1" and LIN2", already folded during the phase shown in FIG. 16.

Continuing its travel along the path P, the partially wrapped ream P reaches another pair of helical folding devices 98 of known type, also disposed on opposite sides with respect to the axis A and equidistant from this axis A.

Figure 18:
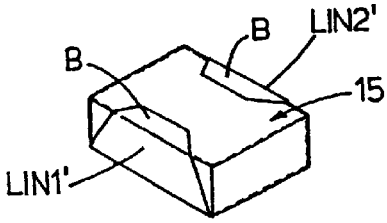

These folding devices 98 are adapted further to fold the end limb of the two lower tongues LIN1' and LIN2' onto the upper face 16*a* of the ream 11 in order to form two folded edges B (FIG. 18) glued on the outer surface of the upper portion of the first tube PT. The desired pack 15 is therefore provided.

In order to improve the transport of the already partly wrapped reams 11, means (not shown) are provided in order to create a vacuum. In this respect, these means are pneumatically connected with two boxes 99*a* and 99*b* which are respectively disposed below the portions of the conveyors 51, 91 that lie in the plane RIF. It will be appreciated that the belts used to form these conveyors 51, 91 have a plurality of holes F by means of which the desired locking by suction of the already partly wrapped reams 11 and the packs 15 is performed, which reams and packs are than removed from the apparatus 10 for subsequent use.

The electronic control unit 100, in addition to controlling the speed of the conveyors 22, 23, is able to regulate all the other operations performed by the apparatus 10. In particular, for the reasons already discussed above with reference to the conveyors 22, 23, this control unit 100 is adapted to control the speeds of the belts of the conveyors 51 and 52.

The advantages of the apparatus and method of the present invention are as follows:

reduction of the overall length of the apparatus, having caused the unit for forming the initial wrapping to coincide with the unit for folding the lateral flaps;

greater compactness with a substantial reduction of the production costs of the apparatus;

possibility of processing reams of small format as a result of the use of a retractile conveyor that comes into contact with the first wrapping tube in order to cause the displacement of this first wrapping tube to the other folding and adhesion units.

What is claimed is:

1. An apparatus for wrapping reams of paper, which apparatus comprises:

a feeding unit for forming and feeding the reams along a horizontal path;

folding units for folding a wrapping sheet into a first tube round a ream of paper;

first folding devices for the lateral folding of the first tube in order to form lateral flaps so as to obtain two lower tongues and two upper tongues;

second folding devices for folding the upper tongues;

first spray devices for spraying an adhesive substance on the inner surfaces of the lower tongues;

third folding devices for folding the lower tongues over the respective upper tongues, already folded, in order to obtain a pack containing the ream;

the folding units being adjacent to the devices in order simultaneously to form the lateral flaps the folding units comprising a first folding unit for folding the wrapping sheet in a U-shape around the ream;

the wrapping sheet comprising, when folded around the ream in the U-shape, an upper limb wound on the ream;

the first folding unit comprising a lower belt conveyor and an upper belt conveyor for moving the ream together with the U-shape folded wrapping sheet along the path, the upper belt conveyor comprising a belt wound about a series of pulleys; and first actuation means being provided for displacing two pulleys in order to displace the belt in a retracted position enabling the apposition of an adhesive substance on the upper limb by means of a second spray device.

2. An apparatus as claimed in claim 1, in which the first folding unit comprises a lower folding member, an upper folding member, a block, a brush member, and second actuation means for moving synchronously the lower folding member and the upper folding member from a first retracted position to a second forward position, in which forward position the lower folding member is in abutment with the block and the upper folding member is in abutment with the brush member.

3. An apparatus as claimed in claim 2, in which the second actuation means comprise an articulated quadrilateral mechanism.

4. An apparatus as claimed in claim 2, in which the block is substantially L-shaped, with a vertical portion perpendicular to the path and a horizontal portion.

5. An apparatus as claimed in claim 1, in which the wrapping sheet comprises, when folded around the ream in the U-shape, a lower limb projecting from the ream; the folding units comprising a second folding unit which comprises a wall and third actuation means for sliding the wall into an interstice in order to urge an end portion of the lower limb of the wrapping sheet upwards.

6. An apparatus as claimed in claim 5, in which the second folding unit comprises a stop, a brush device, and fourth actuation means for displacing the brush device from a first disengaged position to a second position of engagement with the stop, where the lower limb of the wrapping sheet is taken up, by vertically displacing and by rotating the brush device.

7. An apparatus as claimed in claim 1, in which the second folding unit comprises a vacuum retaining device for retaining the lower lint of the wrapping sheet.

8. An apparatus as claimed in claim 1, in which the first folding devices comprise follower arms movable along said path in order to follow the ream and rotatable about respective axes of rotation in order simultaneously to form the lateral flaps.

9. An apparatus as claimed in claim 1, and further comprising an electronic control unit for controlling the feeding unit, the folding units, the first, second, and third folding devices, and the spray devices and for controlling the speeds of the feeding unit and of the lower and upper belt conveyors in order to have identical speeds of advancement of the reams both along the feeding unit and the first folding unit.

10. An apparatus as claimed in claim 1, and further comprising a removal unit disposed downstream of the first folding unit in order to provide a free space between the first folding unit and the removal unit; said first spray devices being positioned at the location of said free space.

11. An apparatus for wrapping reams of paper, which apparatus comprises:

a feeding unit for forming and feeding the reams along a horizontal path;

folding units for folding a wrapping sheet into a first tube around a ream of paper;

first folding devices for the lateral folding of the first tube in order to form lateral flaps so as to obtain two lower tongues and two upper tongues;

second folding devices for folding the upper tongues;

first spray devices for spraying an adhesive substance on the inner surfaces of the lower tongues;

third folding devices for folding the lower tongues over the respective upper tongues, already folded, in order to obtain a pack containing the ream;

the folding units being adjacent to the first folding devices in order simultaneously to form the lateral flaps;

the folding units comprising a first folding unit for folding the wrapping sheet in a U-shape wound the ream;

the wrapping sheet comprising, when folded around the ream in the U-shape, a lower limb projecting from the ream;

the folding units comprising a second folding unit which comprises a wall and third actuation means for sliding the wall into an interstice in order to urge an end portion of the lower limb upwards;

the second folding unit comprising a stop, a brush device, and fourth actuation means for displacing the brush device from a first disengaged position to a second position of engagement with the stop, where the lower limb is taken up, by vertically displacing and by rotating the brush device.

* * * * *